US008299983B2

(12) United States Patent
Levey et al.

(10) Patent No.: US 8,299,983 B2
(45) **Date of Patent: *Oct. 30, 2012**

(54) ELECTROLUMINESCENT DISPLAY WITH INITIAL NONUNIFORMITY COMPENSATION

(75) Inventors: Charles I. Levey, West Henrietta, NY (US); Gary Parrett, Rochester, NY (US)

(73) Assignee: Global OLED Technology LLC, Herndon, VA (US)

( * ) Notice: Subject to any disclaimer, the term of this patent is extended or adjusted under 35 U.S.C. 154(b) by 1040 days.

This patent is subject to a terminal disclaimer.

(21) Appl. No.: 12/258,388

(22) Filed: Oct. 25, 2008

(65) Prior Publication Data

US 2010/0103082 A1 Apr. 29, 2010

(51) Int. Cl.
*G09G 3/30* (2006.01)

(52) U.S. Cl. ..... 345/76; 345/212

(58) Field of Classification Search ..... 345/76, 345/78, 212, 90, 82; 315/291; 250/214.1, 250/332; 348/241

See application file for complete search history.

(56) References Cited

U.S. PATENT DOCUMENTS

| | | | | |
|---|---|---|---|---|
| 6,081,073 | A | 6/2000 | Salam | |
| 6,414,661 | B1 * | 7/2002 | Shen et al. | 345/82 |
| 6,456,016 | B1 * | 9/2002 | Sundahl et al. | 315/291 |
| 6,473,065 | B1 | 10/2002 | Fan | |
| 6,897,842 | B2 | 5/2005 | Gu | |
| 7,859,501 | B2 * | 12/2010 | Levey et al. | 345/90 |
| 7,956,830 | B2 * | 6/2011 | Chen et al. | 345/82 |
| 2003/0122813 | A1 | 7/2003 | Ishizuki et al. | |
| 2005/0007392 | A1 | 1/2005 | Kasai et al. | |
| 2006/0158402 | A1 | 7/2006 | Nathan et al. | |
| 2006/0273997 | A1 | 12/2006 | Nathan et al. | |
| 2007/0195020 | A1 | 8/2007 | Nathan et al. | |
| 2008/0048951 | A1 | 2/2008 | Naugler, Jr. et al. | |
| 2008/0252568 | A1 | 10/2008 | Kwon | |

FOREIGN PATENT DOCUMENTS

WO WO 2005/109389 A1 11/2005

OTHER PUBLICATIONS

Kuo et al, Thin Film Transistors: Materials and Processes, vol. 2: Polycrystalline Thin Film Transistors, Boston, Kluwer Academic Publishers, 2004, p. 412

* cited by examiner

*Primary Examiner* — Quan-Zhen Wang
*Assistant Examiner* — Yuk Chow
(74) *Attorney, Agent, or Firm* — Morgan, Lewis & Bockius LLP

(57) ABSTRACT

A method of compensating for differences in characteristics of a plurality of electroluminescent (EL) subpixels having readout transistors, includes providing a first voltage source connected through a first switch to each subpixel's drive transistor and a second voltage source connected through a second switch to each subpixel's EL emitter; providing a current source connected through a third switch, and a current sink connected through a fourth switch, to the readout transistor; providing a test voltage to a subpixel; closing only the first and fourth switches and measuring the readout transistor voltage to provide a first signal representative of characteristics of the drive transistor; closing only the second and third switches and measuring the voltage to provide a second signal representative of characteristics of the EL emitter; repeating for each subpixel; and using the first and second signals for each subpixel to compensate for differences in characteristics of the EL subpixels.

11 Claims, 5 Drawing Sheets

ELECTROLUMINESCENT DISPLAY WITH INITIAL NONUNIFORMITY COMPENSATION

CROSS REFERENCE TO RELATED APPLICATION

Reference is made to commonly-assigned, co-pending U.S. patent application Ser. No. 11/766,823, filed Jun. 22, 2007, entitled "OLED Display with Aging and Efficiency Compensations" by Levey et al, the disclosure of which is incorporated by reference herein.

FIELD OF THE INVENTION

The present invention relates to solid-state electroluminescent flat-panel displays and more particularly to such displays having ways to compensate for differences in the characteristics of the various components composing such displays.

BACKGROUND OF THE INVENTION

Electroluminescent (EL) devices have been known for some years and have been recently used in commercial display devices. Such devices employ both active-matrix and passive-matrix control schemes and can employ a plurality of subpixels. Each subpixel contains an EL emitter and a drive transistor for driving current through the EL emitter. The subpixels are typically arranged in two-dimensional arrays with a row and a column address for each subpixel, and having a data value associated with the subpixel. Subpixels of different colors, such as red, green, blue and white, are grouped to form pixels. EL displays can be made from various emitter technologies, including coatable-inorganic light-emitting diode, quantum-dot, and organic light-emitting diode (OLED). However, such displays suffer from a variety of defects that limit the quality of the displays. In particular, OLED displays suffer from visible nonuniformities in the subpixels across a display. These nonuniformities can be attributed to both the EL emitters in the display and, for active-matrix displays, to variability in the thin-film transistors used to drive the EL emitters. FIG. 5 shows an example histogram of subpixel luminance exhibiting differences in characteristics between pixels. All subpixels were driven at the same level, so should have had the same luminance. As FIG. 5 shows, the resulting luminances varied by 20 percent in either direction. This results in unacceptable display performance.

Some transistor technologies, such as low-temperature polysilicon (LTPS), can produce drive transistors that have varying mobilities and threshold voltages across the surface of a display (Kuo, Yue, ed. *Thin Film Transistors: Materials and Processes, vol.* 2: *Polycrystalline Thin Film Transistors*. Boston: Kluwer Academic Publishers, 2004, pg. 412). This produces objectionable visible nonuniformity. Further, nonuniform OLED material deposition can produce emitters with varying efficiencies, also causing objectionable nonuniformity. These nonuniformities are present at the time the panel is sold to an end user, and so are termed initial nonuniformities.

It is known in the prior art to measure the performance of each pixel in a display and then to correct for the performance of the pixel to provide a more uniform output across the display. U.S. Patent Application Publication No. 2003/0122813 A1 by Ishizuki et al. discloses a display panel driving device and driving method for providing high-quality images without irregular luminance. The light-emission drive current flowing is measured while each pixel successively and independently emits light. Then the luminance is corrected for each input pixel data based on the measured drive current values. According to another aspect, the drive voltage is adjusted such that one drive current value becomes equal to a predetermined reference current. In a further aspect, the current is measured while an off-set current, corresponding to a leak current of the display panel, is added to the current output from the drive voltage generator circuit, and the resultant current is supplied to each of the pixel portions. The measurement techniques are iterative, and therefore slow. Further, this technique is directed at compensation for aging, not for initial nonuniformity.

U.S. Pat. No. 6,081,073 entitled "Matrix Display with Matched Solid-State Pixels" by Salam, describes a display matrix with a process and control circuitry for reducing brightness variations in the pixels. This patent describes the use of a linear scaling method for each pixel based on a ratio between the brightness of the weakest pixel in the display and the brightness of each pixel. However, this approach will lead to an overall reduction in the dynamic range and brightness of the display and a reduction and variation in the bit depth at which the pixels can be operated.

U.S. Pat. No. 6,473,065 B1 entitled "Methods of improving display uniformity of organic light emitting displays by calibrating individual pixel" by Fan, describes methods of improving the display uniformity of an OLED. In order to improve the display uniformity of an OLED, the display characteristics of all organic-light-emitting-elements are measured, and calibration parameters for each organic-light-emitting-element are obtained from the measured display characteristics of the corresponding organic-light-emitting-element. The calibration parameters of each organic-light-emitting-element are stored in a calibration memory. The technique uses a combination of look-up tables and calculation circuitry to implement uniformity correction. However, the described approaches require either a lookup table providing a complete characterization for each pixel, or extensive computational circuitry within a device controller. This is likely to be expensive and impractical in most applications.

U.S. Pat. No. 6,414,661 B1 entitled "Method and apparatus for calibrating display devices and automatically compensating for loss in their efficiency over time" by Shen et al., describes a method and associated system that compensates for long-term variations in the light-emitting efficiency of individual organic light emitting diodes in an OLED display device by calculating and predicting the decay in light output efficiency of each pixel based on the accumulated drive current applied to the pixel and derives a correction coefficient that is applied to the next drive current for each pixel. This patent describes the use of a camera to acquire images of a plurality of equal-sized sub-areas. Such a process is time-consuming and requires mechanical fixtures to acquire the plurality of sub-area images.

U.S. Patent Application Publication No. 2005/0007392 A1 by Kasai et al. describes an electro-optical device that stabilizes display quality by performing correction processing corresponding to a plurality of disturbance factors. A grayscale characteristic generating unit generates conversion data having grayscale characteristics obtained by changing the grayscale characteristics of display data that defines the grayscales of pixels with reference to a conversion table whose description contents include correction factors. However, their method requires a large number of LUTs, not all of which are in use at any given time, to perform processing, and does not describe a method for populating those LUTs.

U.S. Pat. No 6,897,842 B2 by Gu, describes using a pulse width modulation (PWM) mechanism to controllably drive a display (e.g., a plurality of display elements forming an array of display elements). A non-uniform pulse interval clock is generated from a uniform pulse interval clock, and then used to modulate the width, and optionally the amplitude, of a drive signal to controllably drive one or more display elements of an array of display elements. A gamma correction is provided jointly with a compensation for initial nonuniformity. However, this technique is only applicable to passive-matrix displays, not to the higher-performance active-matrix displays which are commonly employed.

There is a need, therefore, for a more complete approach for compensating differences between components in electroluminescent displays, and specifically for compensating for initial nonuniformity of such displays.

SUMMARY OF THE INVENTION

It is therefore an object of the present invention to compensate for differences in characteristics of a plurality of electroluminescent (EL) subpixels. This object is achieved by a method of compensating for differences in characteristics of a plurality of electroluminescent (EL) subpixels, comprising:

(a) providing for each of a plurality of EL subpixels a drive transistor with a first electrode, a second electrode, and a gate electrode;

(b) providing a first voltage source and a first switch for selectively connecting the first voltage source to the first electrode of each drive transistor;

(c) providing an EL emitter for each EL subpixel connected to the second electrode of the respective drive transistor, and a second voltage source and a second switch for selectively connecting each EL emitter to the second voltage source;

(d) providing for each EL subpixel a readout transistor having a first electrode and a second electrode, and connecting the first electrode of each readout transistor to the second electrode of the respective drive transistor;

(e) providing a current source and a third switch for selectively connecting the current source to the second electrode of each readout transistor;

(f) providing a current sink and a fourth switch for selectively connecting the current sink to the second electrode of each readout transistor;

(g) selecting an EL subpixel and its corresponding drive transistor, readout transistor and EL emitter;

(h) providing a test voltage to the gate electrode of the selected drive transistor and providing a voltage measurement circuit connected to the second electrode of the selected readout transistor;

(i) closing the first and fourth switches and opening the second and third switches, and using the voltage measurement circuit to measure the voltage at the second electrode of the selected readout transistor to provide a corresponding first signal representative of characteristics of the selected drive transistor;

(j) opening the first and fourth switches, closing the second and third switches, and using the voltage measurement circuit to measure the voltage at the second electrode of the selected readout transistor to provide a corresponding second signal representative of characteristics of the selected EL emitter;

(k) repeating steps g through j for each remaining EL subpixel in the plurality of EL subpixels; and (l) using the first and second signals for each subpixel to compensate for differences in characteristics of the plurality of EL subpixels.

An advantage of this invention is an electroluminescent (EL) display that compensates for differences in characteristics of the EL subpixels composing an EL display, and particularly for the initial nonuniformity of the display, without requiring extensive or complex circuitry for accumulating a continuous measurement of light-emitting element use or time of operation. It is a further advantage of this invention that it uses simple voltage measurement circuitry. It is a further advantage of this invention that by making all measurements of voltage, it is more sensitive to changes than methods that measure current. It is a further advantage of this invention that compensation for changes in driving transistor properties can be performed with compensation for the OLED changes, thus providing a complete compensation solution. It is a further advantage of this invention that both aspects of measurement and compensation (OLED and driving transistor) can be accomplished rapidly, and without confounding the two. This advantageously provides increased signal-to-noise ratio in the compensation measurements. It is a further advantage of this invention that a single select line can be used to enable data input and data readout. It is a further advantage of this invention that characterization and compensation of the characteristics of the driving transistor and EL emitter in a subpixel are unique to the specific subpixel and are not impacted by other subpixels that may be open-circuited or short-circuited.

DETAILED DESCRIPTION OF THE INVENTION

Figure 1:
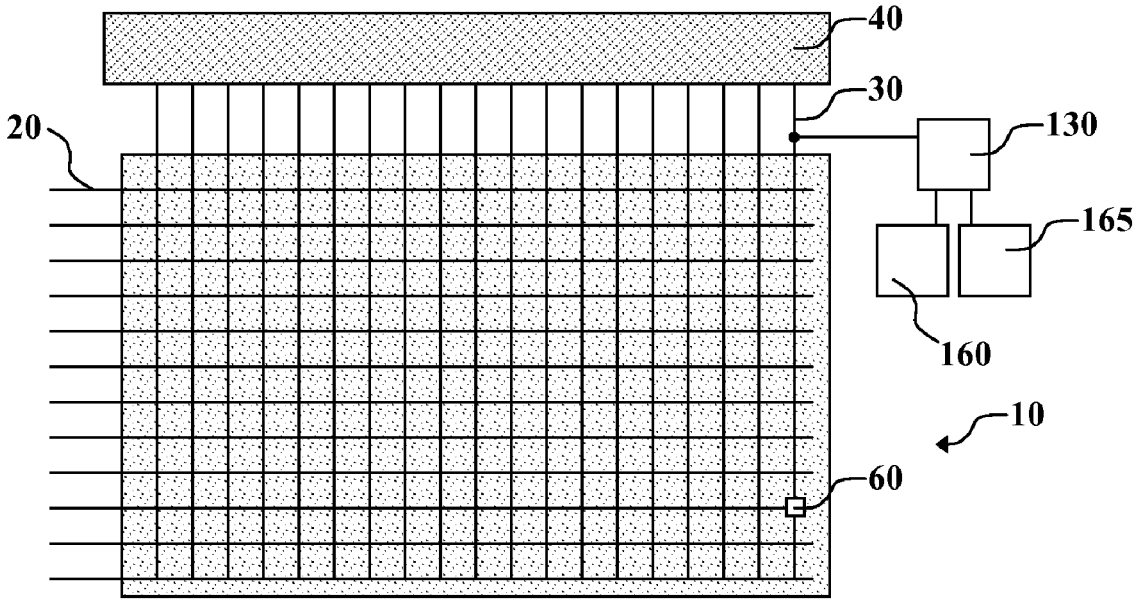
FIG. 1 is a schematic diagram of one embodiment of an electroluminescent (EL) display that can be used in the practice of the present invention.

Turning now to FIG. 1, there is shown a schematic diagram of one embodiment of an electroluminescent (EL) display that can be used in the practice of the present invention. EL display 10 includes an array of a predetermined number of EL subpixels 60 arranged in rows and columns. Note that the rows and the columns can be oriented differently than shown here; for example, they can be rotated ninety degrees. EL display 10 includes a plurality of select lines 20 wherein each row of EL subpixels 60 has a select line 20. EL display 10 includes a plurality of readout lines 30 wherein each column of EL subpixels 60 has a readout line 30. Each readout line 30 is connected to a switch block 130, which connects readout line 30 to either a current source 160 or a current sink 165 during the calibration process. Although not shown for clarity of illustration, each column of EL subpixels 60 also has a data line as well-known in the art. The plurality of readout lines 30 is connected to one or more multiplexers 40, which permits parallel/sequential readout of signals from EL subpixels 60, as will become apparent. Multiplexer 40 can be a part of the same structure as EL display 10, or can be a separate construction that can be connected to or disconnected from EL display 10.

Figure 2:
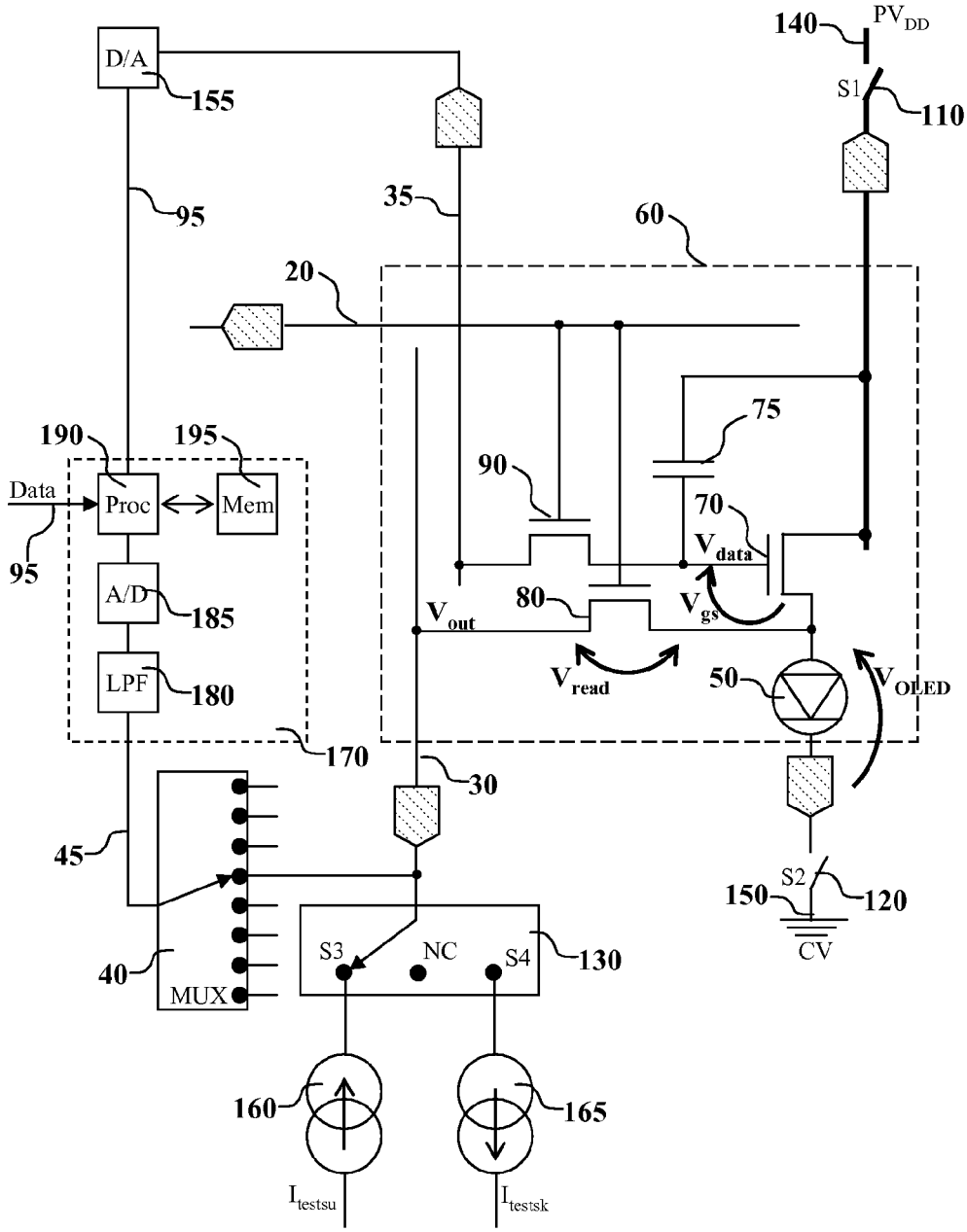
FIG. 2 is a schematic diagram of one embodiment of an EL subpixel that can be used in the practice of the present invention.

Turning now to FIG. 2, there is shown a schematic diagram of one embodiment of an EL subpixel that can be used in the practice of the present invention. EL subpixel 60 includes an EL emitter 50, a drive transistor 70, a capacitor 75, a readout transistor 80, and a select transistor 90. Each of the transistors has a first electrode, a second electrode, and a gate electrode. A first voltage source 140 can be selectively connected to the first electrode of drive transistor 70 by a first switch 110, which can be located on the EL display substrate or on a separate structure. By connected, it is meant that the elements are directly connected or electrically connected via another component, e.g. a switch, a diode, or another transistor. The second electrode of drive transistor 70 is connected to EL emitter 50, and a second voltage source 150 can be selectively connected to EL emitter 50 by a second switch 120, which can also be off the EL display substrate. At least one first switch 110 and second switch 120 are provided for the EL display. Additional first and second switches can be provided if the EL display has multiple powered subgroupings of pixels. In normal display mode, the first and second switches are closed, while other switches (described below) are open. The gate electrode of drive transistor 70 is connected to select transistor 90 to selectively provide data from a data line 35 to drive transistor 70 as well known in the art. The select line 20 is connected to the gate electrodes of the select transistors 90 in the row of EL subpixels 60. The gate electrode of select transistor 90 is connected to the gate electrode of readout transistor 80.

The first electrode of readout transistor 80 is connected to the second electrode of drive transistor 70 and to EL emitter 50. The readout line 30 is connected to the second electrodes of the readout transistors 80 in a column of subpixels 60. Readout line 30 is connected to switch block 130. One switch block 130 is provided for each column of EL subpixels 60. Switch block 130 includes a third switch S3 and a fourth switch S4, and a No-Connect state NC. While the third and fourth switches can be individual entities, they are never closed simultaneously in this method, and thus switch block 130 provides a convenient embodiment of the two switches. The third switch permits current source 160 to be selectively connected to the second electrode of readout transistor 80. Current source 160, when connected by the third switch, permits a predetermined constant current to flow into EL subpixel 60. The fourth switch permits current sink 165 to be selectively connected to the second electrode of readout transistor 80. Current sink 165, when connected by the fourth switch, permits a predetermined constant current to flow from EL subpixel 60 when a predetermined data value is applied to data line 35. Switch block 130, current source 160, and current sink 165 can be located on or off the EL display substrate.

In an EL display including a plurality of EL subpixels, the single current source and sink are selectively connected through the third and fourth switches, respectively, to the second electrode of each readout transistor in the plurality of EL subpixels. More than one current source or sink can be used provided the second electrode of the readout transistor is selectively connected to either one current source or one current sink, or nothing, at any given time.

The second electrode of readout transistor 80 is also connected to a voltage measurement circuit 170, which measures voltages to provide signals representative of characteristics of EL subpixel 60. Voltage measurement circuit 170 includes an analog-to-digital converter 185 for converting voltage measurements into digital signals, and a processor 190. The signal from analog-to-digital converter 185 is sent to processor 190. Voltage measurement circuit 170 can also include a memory 195 for storing voltage measurements, and a low-pass filter 180 if necessary. Voltage measurement circuit 170 can be connected through multiplexer output line 45 and multiplexer 40 to a plurality of readout lines 30 and readout transistors 80 for sequentially reading out the voltages from a predetermined number of EL subpixels 60. If there are a plurality of multiplexers 40, each can have its own multiplexer output line 45. Thus, a predetermined number of EL subpixels 60 can be driven simultaneously. The plurality of multiplexers 40 will permit parallel reading out of the voltages from the various multiplexers 40, while each multiplexer 40 would permit sequential reading out of the readout lines 30 attached to it. This will be referred to herein as a parallel/sequential process.

Processor 190 can also be connected to data line 35 by way of a control line 95 and a digital-to-analog converter 155. Thus, processor 190 can provide predetermined data values to data line 35 during the measurement process to be described herein. Processor 190 can also accept display data via data in 85 and provide compensation for changes as will be described herein, thus providing compensated data to data line 35 during the display process.

The embodiment shown in FIG. 1 is a non-inverted, NMOS subpixel. Other configurations as known in the art can be employed with the present invention. Each transistor (70, 80, 90) can be N-channel or P-channel, and the EL emitter 50 can be connected to the drive transistor 70 in an inverted or non-inverted arrangement. The EL emitter 50 can be an organic light-emitting diode (OLED) emitter, as disclosed in but not limited to U.S. Pat. No. 4,769,292, by Tang et al., and U.S. Pat. No. 5,061,569, by VanSlyke et al, or other emitter types known in the art. When the EL emitter 50 is an OLED emitter, the EL subpixel 60 is an OLED subpixel, and the EL display 10 is an OLED display. The drive transistor 70, and the other transistors (80, 90), can be low-temperature polysilicon (LTPS), zinc oxide (ZnO), or amorphous silicon (a-Si) transistors, or a transistors of another type known in the art.

Transistors such as drive transistor 70 of EL subpixel 60 have characteristics including threshold voltage $V_{th}$ and mobility $\mu$. The voltage on the gate electrode of drive transistor 70 must be greater than the threshold voltage to enable significant current flow between the first and second electrodes. The mobility relates to the amount of current flow when the transistor is conducting. When using a display with a transistor backplane of low-temperature polysilicon (LTPS) transistors, not all transistors in the display necessarily have identical $V_{th}$ or mobility values. Differences between characteristics of the various drive transistors in the EL subpixels 60 can result in visible nonuniformity in light output across the surface of a display when all drive transistors are driven by the same gate-source voltage $V_{gs}$. Such nonuniformity can include differences in brightness and color balance in different parts of the display. It is desirable to compensate for such differences in the threshold voltage and mobility to prevent such problems. Also, there can be differences in the characteristics of the EL emitters 50, such as efficiency or resistance, which can also cause visible nonuniformity.

The present invention can compensate for differences in characteristics and the resulting nonuniformities at any desired time. However, nonuniformities are particularly objectionable to end users seeing a display for the first time. The operating life of an EL display is the time from when an end user first sees an image on that display to the time when that display is discarded. Initial nonuniformity is any nonuniformity present at the beginning of the operating life of a display. The present invention can advantageously correct for initial nonuniformity by taking measurements before the operating life of the EL display begins. Measurements can be taken in the factory as part of production of a display. Measurements can also be taken after the user first activates a product containing an EL display, immediately before showing the first image on that display. This permits the display to present a high-quality image to the end user when he first sees it, so that his first impression of the display will be favorable.

Figure 3:
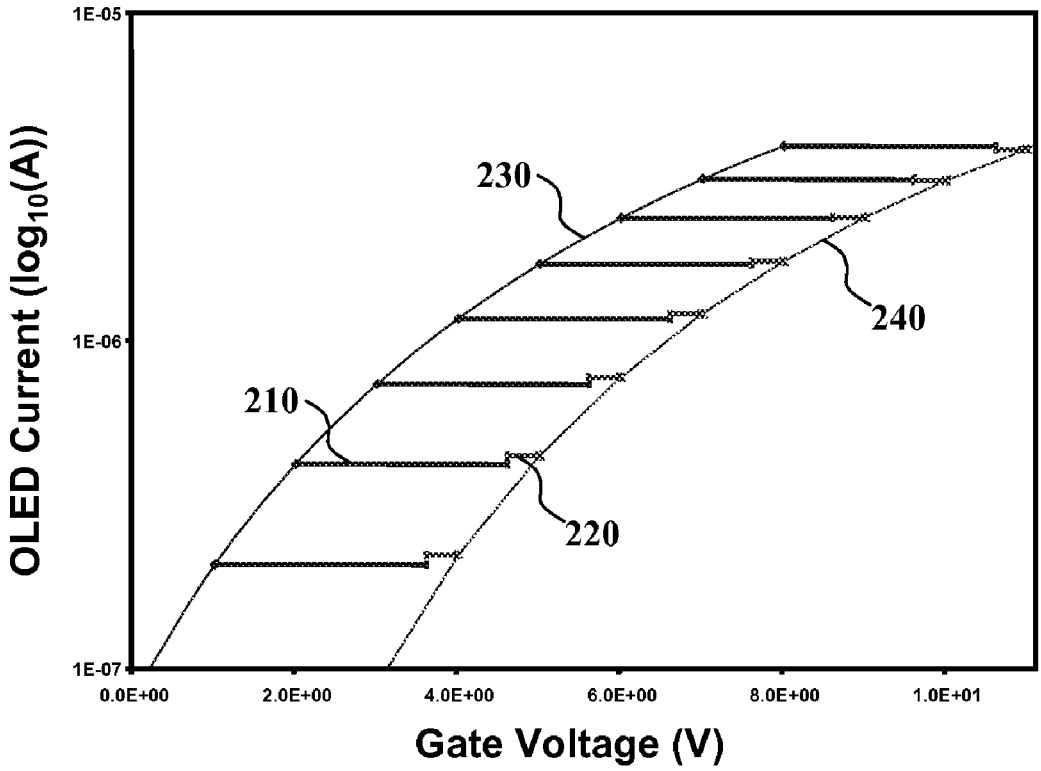
FIG. 3 is a diagram illustrating the effect on device current of differences in characteristics of two EL subpixels.

Turning now to FIG. 3, there is shown a diagram illustrating the effect of differences in characteristics of two EL emitters or drive transistors, or both, on EL subpixel current. The abscissa of FIG. 3 represents the gate voltage at drive transistor 70. The ordinate is the base-10 logarithm of the current through the EL emitter 50. A first EL subpixel I-V characteristic 230 and a second EL subpixel I-V characteristic 240 show the I-V curves for two different EL subpixels 60. For characteristic 240, a greater voltage is required than for characteristic 230 to obtain a desired current; that is, the curve is shifted right by an amount ΔV. ΔV is the sum of the change in threshold voltage ($\Delta V_{th}$, 210) and the change in EL voltage resulting from a change in EL emitter resistance ($\Delta V_{EL}$, 220), as shown. This change results in nonuniform light emission between the subpixels having characteristics 230 and 240, respectively: a given gate voltage will control less current, and therefore less light, on characteristic 240 than on characteristic 230.

The relationship between the EL current (which is also the drain-source current through the drive transistor), EL voltage, and threshold voltage at saturation is:

$$I_{EL} = \frac{W\bar{\mu}C_0}{2L}(V_{gs} - V_{th})^2 = \frac{K}{2}(V_g - V_{EL} - V_{th})^2 \quad \text{(Eq. 1)}$$

where W is the TFT Channel Width, L is the TFT Channel Length, μ is the TFT mobility, $C_0$ is the Oxide Capacitance per Unit Area, $V_g$ is the gate voltage, $V_{gs}$ is voltage difference between gate and source of the drive transistor. For simplicity, we neglect dependence of μ on $V_{gs}$. Thus, to produce the same current from subpixels having characteristics 230 and 240, one must compensate for differences in $V_{th}$ and $V_{EL}$. It is therefore desirable to measure both changes.

Figure 4:
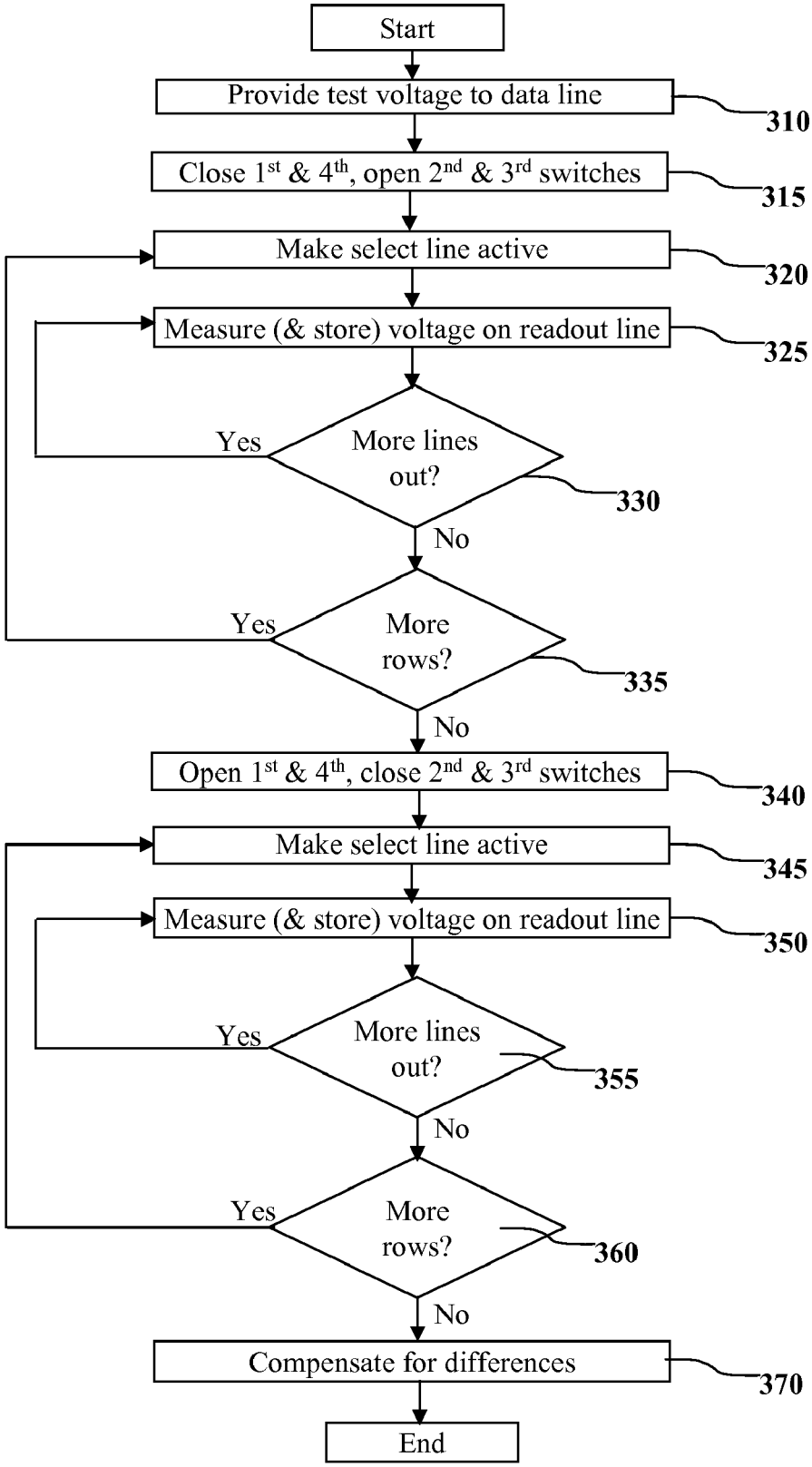
FIG. 4 is a block diagram of one embodiment of the method of the present invention.
Figure 5:
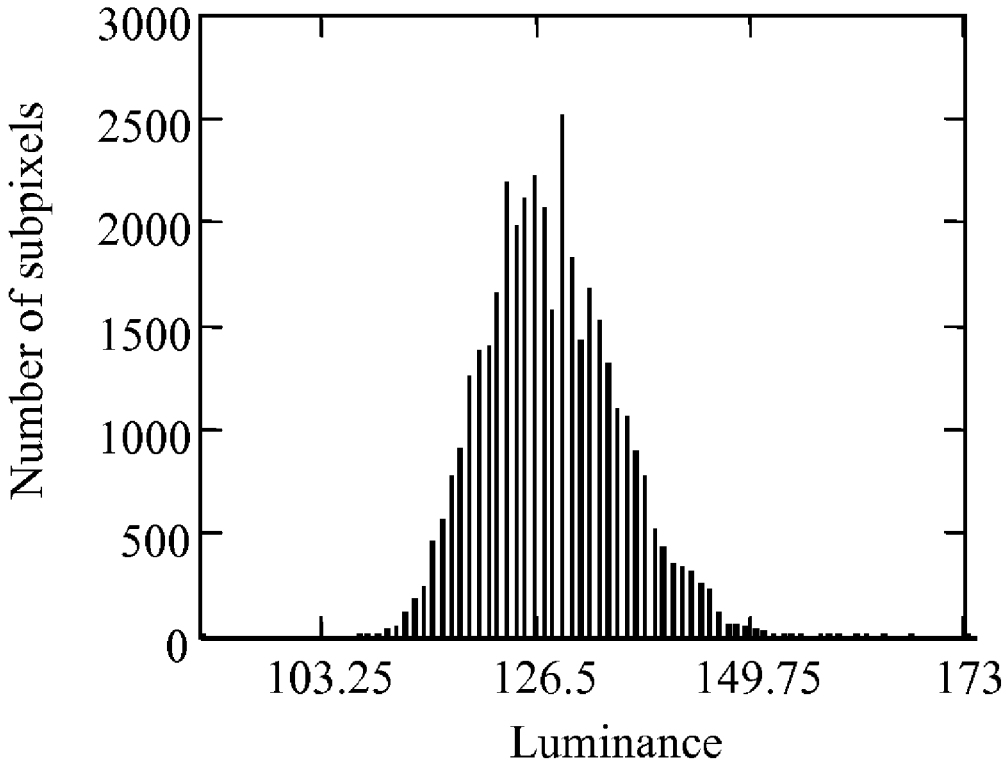
FIG. 5 is a histogram of pixel luminance exhibiting differences in characteristics between pixels.

Turning now to FIG. 4, and referring also to FIG. 2, there is shown a block diagram of one embodiment of the method of the present invention. A predetermined test voltage ($V_{data}$) is provided to data line 35 (Step 310). First switch 110 is closed and second switch 120 is opened. The fourth switch is closed and the third switch is opened, that is, switch block 130 is switched to S4 (Step 315). Select line 20 is made active for a selected row to provide the test voltage to the gate electrode of drive transistor 70 and to turn on readout transistor 80 in a selected EL subpixel (Step 320). This selects the drive transistor, readout transistor and EL emitter of the selected EL subpixel. A current thus flows from first voltage source 140 through drive transistor 70 to current sink 165. The value of current ($I_{testsk}$) through current sink 165 is selected to be less than the resulting current through drive transistor 70 due to the application of $V_{data}$; a typical value will be in the range of 1 to 5 microamps and will be constant for all measurements taken in a particular measurement set. The selected value of $V_{data}$ is constant for all such measurements, and therefore must be sufficient to command a current through drive-transistor 70 greater than that at current sink 165 even after aging expected during the lifetime of the display. Thus, the limiting value of current through drive transistor 70 will be controlled entirely by current sink 165, which will be the same as through drive transistor 70. The value of $V_{data}$ can be selected based upon known or determined current-voltage and aging characteristics of drive transistor 70. More than one measurement value can be used in this process, e.g. one can choose to do the measurement at 1, 2, and 3 microamps. A value of $V_{data}$ must be used that is sufficient to command a current not smaller than the largest test current. Voltage measurement circuit 170 is used to measure the voltage on readout line 30, which is the voltage $V_{out}$ at the second electrode of selected readout transistor 80, providing a corresponding first signal $V_1$ that is representative of characteristics of selected drive transistor 70 (Step 325), including the threshold voltage $V_{th}$ of drive transistor 70. If the EL display incorporates a plurality of EL subpixels and there are additional EL subpixels in the row to be measured, multiplexer 40 connected to a plurality of readout lines 30 can be used to permit voltage measurement circuit 170 to sequentially read out the first signals $V_1$ from a predetermined number of EL subpixels, e.g. every subpixel in the row (Step 330). If the display is sufficiently large, it can require a plurality of multiplexers wherein the first signal can be provided in a parallel/sequential process. If there are additional rows of subpixels to be measured (Step 335), a different row is selected by a different select line and the measurements are repeated.

The voltages of the components in each subpixel can be related by:

$$V_1 = V_{data} - V_{gs(Itestsk)} - V_{read} \quad \text{(Eq. 2)}$$

where $V_{gs(Itestsk)}$ is the gate-to-source voltage that must be applied to drive transistor 70 such that it's drain-to-source current, $I_{ds}$, is equal to $I_{testsk}$. The values of these voltages will cause the voltage at the second electrode of readout transistor 80 ($V_{out}$, which is read to provide $V_1$) to adjust to fulfill Eq. 2. Under the conditions described above, $V_{data}$ is a set value and $V_{read}$ can be assumed to be constant. $V_{gs}$ will be controlled by the value of the current set by current sink 165 and the current-voltage characteristics of drive transistor 70, and will be different for different values of the threshold voltage of the drive transistor. To compensate for mobility variations, two values of $V_1$ must be taken at different values of $I_{testsk}$.

The value of the first signal $V_1$ can be recorded for each subpixel with selected values for current sink 165. Then, the subpixel with the maximum $V_1$ (thus the minimum $V_{gs(testsk)}$, so the minimum $V_{th}$) is selected as the first target signal, $V_{1target}$, from the population of subpixels measured. Alternatively, the minimum or mean of all $V_1$ values, or the results of other functions obvious to those skilled in the art, can be selected as $V_{1target}$. The measured first signal $V_1$ for each subpixel can then be compared to the first target signal $V_{1target}$ to form a delta $\Delta V_1$ for each subpixel, as follows:

$$\Delta V_1 = -\Delta V_{th} = V_1 - V_{1target} \quad \text{(Eq. 3)}$$

$\Delta V_1$ represents the difference in threshold voltage between each subpixel and the target.

Note that the present invention only applies to a plurality of EL subpixels, as a single EL subpixel has no difference in characteristics when there is nothing to compare it to. That is, for a single EL subpixel, $V_1 = V_{1target}$, so $\Delta V_1 = 0$ always.

Referring back to FIG. 4, to measure the EL emitter, first switch 110 is then opened and second switch 120 is closed. Switch block 130 is switched to S3, thereby opening the fourth switch and closing the third switch (Step 340). Select line 20 is made active for a selected row to turn on readout transistor 70 (Step 345). A current, $I_{testsu}$, thus flows from current source 160 through EL emitter 50 to second voltage source 150. The value of current through current source 160 is selected to be less than the maximum current possible through EL emitter 50; a typical value will be in the range of 1 to 5 microamps and will be constant for all measurements taken in a particular measurement set. More than one measurement value can be used in this process, e.g. one can choose to do the measurement at 1, 2, and 3 microamps. Voltage measurement circuit 170 is used to measure the voltage on readout line 30, which is the voltage $V_{out}$ at the second electrode of selected readout transistor 80, providing a second signal $V_2$ that is representative of characteristics of selected EL emitter 50, including the resistance of EL emitter 50 (Step 350). If there are additional EL subpixels in the row to be measured, multiplexer 40 connected to a plurality of readout lines 30 can be used to permit voltage measurement circuit 170 to sequentially read out the second signal $V_2$ for a predetermined number of EL subpixels, e.g. every subpixel in the row (Step 355). If the display is sufficiently large, it can require a plurality of multiplexers wherein the second signal can be provided in a parallel/sequential process. If there are additional rows of subpixels to be measured in EL display 10, Steps 345 to 355 are repeated for each row (Step 360).

The voltages of the components in each subpixel can be related by:

$$V_2=CV+V_{EL}+V_{read} \quad \text{(Eq. 4)}$$

The values of these voltages will cause the voltage at the second electrode of readout transistor 80 ($V_{out}$, which is read to provide $V_2$) to adjust to fulfill Eq. 4. Under the conditions described above, CV is a set value and $V_{read}$ can be assumed to be constant. $V_{EL}$ will be controlled by the value of current set by current source 160 and the current-voltage characteristics of EL emitter 50. $V_{EL}$ can be different for different EL emitters 50.

The value of the second signal $V_2$ can be recorded for each subpixel with selected values for current source 160. Then, the subpixel with the minimum $V_{EL}$ (that is, the minimum measured $V_2$) is selected as the second target signal, $V_{2target}$, from the population of subpixels measured. Alternatively, the maximum or mean, or the results of other functions obvious to those skilled in the art, of all $V_2$ values can be selected as $V_{2target}$. The measured second signal $V_2$ for each subpixel can then be compared to the second target signal $V_{2target}$ to form a delta $\Delta V_2$, as follows:

$$\Delta V_2=\Delta V_{EL}=V_2-V_{2target} \quad \text{(Eq. 5)}$$

$\Delta V_2$ represents the difference in EL emitter voltage between each subpixel and the target.

When measuring each EL subpixel in a plurality of EL subpixels, the first signal can be read for all EL subpixels, and then the second signal can be read for all EL subpixels, as shown in FIG. 4. However, the measurements can be interleaved. The first signal can be read for a first EL subpixel, then the second signal can be read for the first EL subpixel, then the first signal can be read for a second EL subpixel, then the second signal can be read for the second EL subpixel, and so forth until the first and second signals have been read for all EL subpixels in the plurality of EL subpixels.

The deltas $\Delta V_1$ and $\Delta V_2$ in the first and second signals, respectively, of each EL subpixel can then be used to compensate for differences (Step 370) in the characteristics of different EL subpixels 60 in a plurality of EL subpixels, such as EL display. For compensating for differences in current between multiple subpixels, it is necessary to make a correction for $\Delta V_{th}$ (related to $\Delta V_1$) and $\Delta V_{EL}$ (related to $\Delta V_2$).

To compensate for the differences in characteristics of EL subpixels 60, one can use the deltas in the first and second signals in an equation of the form:

$$\Delta V_{data}=f_1(\Delta V_1)+f_2(\Delta V_2) \quad \text{(Eq. 7)}$$

where $\Delta V_{data}$ is an offset voltage on the gate electrode of drive transistor 70 necessary to maintain the desired luminance specified by a selected $V_{data}$, $f_1(\Delta V_1)$ is a correction for differences in threshold voltage, and $f_2(\Delta V_2)$ is a correction for differences in EL resistance. $\Delta V_1$ is as given in Eq. 3; $\Delta V_2$ is as given in Eq. 5. For example, the EL display can include a controller, which can include a lookup table or algorithm to compute an offset voltage for each EL emitter. For example, $f_1$ can be a linear function since $I_{ds}$ of a drive transistor is determined by $V_{gs}-V_{th}$, so a given $V_{th}$ change $\Delta V_1$ can be compensated for by changing $V_{data}$ (which approximately equals $V_g$) by the same amount. In embodiments having the EL emitter connected to the source terminal of the drive transistor, $f_2$ can also be a linear function for an analogous reason: changing the source voltage changes $V_{gs}$ by the same amount. For more complex cases, the system can be modeled by techniques known in the art, such as SPICE simulation, and $f_1$ and $f_2$ implemented as lookup tables of precomputed values. To compensate for mobility variations, the two measured $V_1$ values at different $I_{testsk}$ values can be used to determine an offset and a gain which will map the I-V curve for each subpixel onto a reference I-V curve, selected as the mean, minimum, or maximum of the I-V curves of all subpixels. The offset and the gain can be used to transform $V_{data}$ on the reference curve to the equivalent voltage on the transformed curve. This linear transform can account for $V_{th}$ and mobility differences simultaneously.

The offset voltage $\Delta V_{data}$ is computed to provide corrections for differences in current due to differences in the threshold voltages and mobilities of drive transistors 70 and in the resistances of EL emitters 50. This provides a complete compensation solution. These changes can be applied by the controller to correct the light output to the nominal luminance value desired. By controlling the signal applied to the EL emitter, an EL emitter with a constant luminance output and increased lifetime at a given luminance is achieved. Because this method provides a correction for each EL emitter in a display, it will compensate for differences in the characteristics of the plurality of EL subpixels, and can thus compensate for initial nonuniformity of an EL display having a plurality of EL subpixels.

The invention has been described in detail with particular reference to certain preferred embodiments thereof, but it will be understood that variations and modifications can be effected within the spirit and scope of the invention.

| PARTS LIST | |
|---|---|
| 10 | EL display |
| 20 | select line |
| 30 | readout line |
| 35 | data line |
| 40 | multiplexer |
| 45 | multiplexer output line |
| 50 | EL emitter |
| 60 | EL subpixel |
| 70 | drive transistor |
| 75 | capacitor |
| 80 | readout transistor |
| 85 | data in |
| 90 | select transistor |
| 95 | control line |
| 110 | first switch |
| 120 | second switch |
| 130 | switch block |
| 140 | first voltage source |
| 150 | second voltage source |
| 155 | digital-to-analog converter |

-continued

| PARTS LIST | |
|---|---|
| 160 | current source |
| 165 | current sink |
| 170 | voltage measurement circuit |
| 180 | low-pass filter |
| 185 | analog-to-digital converter |
| 190 | processor |
| 195 | memory |
| 210 | $\Delta V_{th}$ |
| 220 | $\Delta V_{EL}$ |
| 230 | first EL subpixel I-V characteristic |
| 240 | second EL subpixel I-V characteristic |
| 310 | step |
| 315 | step |
| 320 | step |
| 325 | step |
| 330 | decision step |
| 335 | decision step |
| 340 | step |
| 345 | step |
| 350 | step |
| 355 | decision step |
| 360 | decision step |
| 370 | step |

The invention claimed is:

1. A method of compensating for differences in characteristics of a plurality of electroluminescent (EL) subpixels, comprising:

(a) providing for each of a plurality of EL subpixels a drive transistor with a first electrode, a second electrode, and a gate electrode;

(b) providing a first voltage source and a first switch for selectively connecting the first voltage source to the first electrode of each drive transistor;

(c) providing an EL emitter for each EL subpixel connected to the second electrode of the respective drive transistor, and a second voltage source and a second switch for selectively connecting each EL emitter to the second voltage source;

(d) providing for each EL subpixel a readout transistor having a first electrode and a second electrode, and connecting the first electrode of each readout transistor to the second electrode of the respective drive transistor;

(e) providing a current source and a third switch for selectively connecting the current source to the second electrode of each readout transistor;

(f) providing a current sink and a fourth switch for selectively connecting the current sink to the second electrode of each readout transistor;

(g) selecting an EL subpixel and its corresponding drive transistor, readout transistor and EL emitter;

(h) providing a test voltage to the gate electrode of the selected drive transistor and providing a voltage measurement circuit connected to the second electrode of the selected readout transistor;

(i) closing the first and fourth switches and opening the second and third switches, and using the voltage measurement circuit to measure the voltage at the second electrode of the selected readout transistor to provide a corresponding first signal representative of characteristics of the selected drive transistor;

(j) opening the first and fourth switches, closing the second and third switches, and using the voltage measurement circuit to measure the voltage at the second electrode of the selected readout transistor to provide a corresponding second signal representative of characteristics of the selected EL emitter;

(k) repeating steps g through j for each remaining EL subpixel in the plurality of EL subpixels; and (l) using the first and second signals for each subpixel to compensate for differences in characteristics of the plurality of EL subpixels.

2. The method of claim 1, wherein the voltage measurement circuit includes an analog-to-digital converter.

3. The method of claim 2, wherein the voltage measurement circuit further includes a low-pass filter.

4. The method of claim 1, wherein steps g through j are performed for a predetermined number of the EL subpixels during which the predetermined number of EL subpixels are driven simultaneously.

5. The method of claim 1, wherein step j includes comparing the measured first and second signals for each of the plurality of EL subpixels to first and second target signals respectively, to compensate for differences in characteristics of the EL sub pixels.

6. The method of claim 1, wherein the EL subpixels are arranged in rows and columns, and further including providing for each row a select line connected to the gate electrodes of the select transistors in that row, and for each column a readout line connected to the second electrodes of the readout transistors in that column.

7. The method of claim 6, further including using a multiplexer connected to the plurality of readout lines for sequentially reading out the first and second signals for the predetermined number of EL subpixels.

8. The method of claim 1, further including providing a select transistor connected to the gate electrode of the drive transistor, and wherein the gate electrode of the select transistor is connected to the gate electrode of the readout transistor.

9. The method of claim 1, wherein each EL emitter is an OLED emitter, and wherein each EL subpixel is an OLED subpixel.

10. The method of claim 1, wherein each drive transistor is a low-temperature polysilicon drive transistor.

11. The method of claim 1, wherein the plurality of EL subpixels compose an EL display, and wherein measurements of steps g through k are taken before the operating life of the EL display.

* * * * *